US008401448B2

(12) United States Patent
Yamaguchi et al.

(10) Patent No.: US 8,401,448 B2
(45) Date of Patent: Mar. 19, 2013

(54) FIXING DEVICE AND IMAGE FORMING APPARATUS INCORPORATING SAME

(75) Inventors: Yoshiki Yamaguchi, Sagamihara (JP); Kenichi Hasegawa, Atsugi (JP); Masaaki Yoshikawa, Tokyo (JP); Hiroshi Yoshinaga, Ichikawa (JP); Kenji Ishii, Kawasaki (JP); Akira Shinshi, Machida (JP); Naoki Iwaya, Choufu (JP); Tetsuo Tokuda, Kawasaki (JP); Ippei Fujimoto, Ebina (JP); Yutaka Ikebuchi, Chigasaki (JP); Shuntaroh Tamaki, Kawasaki (JP); Toshihiko Shimokawa, Zama (JP)

(73) Assignee: Ricoh Company, Ltd., Tokyo (JP)

( * ) Notice: Subject to any disclaimer, the term of this patent is extended or adjusted under 35 U.S.C. 154(b) by 210 days.

(21) Appl. No.: 12/888,980

(22) Filed: Sep. 23, 2010

(65) Prior Publication Data

US 2011/0076071 A1 Mar. 31, 2011

(30) Foreign Application Priority Data

Sep. 28, 2009 (JP) ..... 2009-222331

(51) Int. Cl.
*G03G 15/20* (2006.01)

(52) U.S. Cl. ..... 399/329; 399/328

(58) Field of Classification Search ..... 219/216; 399/122, 328, 331
See application file for complete search history.

(56) References Cited

U.S. PATENT DOCUMENTS 7,702,271 B2 4/2010 Yamada et al.
7,974,561 B2 * 7/2011 Yamano ..... 399/329
2007/0292175 A1 12/2007 Shinshi
2008/0112739 A1 5/2008 Shinshi
2008/0175633 A1 7/2008 Shinshi
2008/0219730 A1 9/2008 Shinshi
2008/0298862 A1 12/2008 Shinshi
2009/0148204 A1 6/2009 Yoshinaga et al.

(Continued)

FOREIGN PATENT DOCUMENTS

JP 10-213984 8/1998
JP 2884714 2/1999

(Continued)

OTHER PUBLICATIONS

U.S. Appl. No. 12/780,309, filed May 15, 2010, Kenichi Hasegawa, et al.

(Continued)

*Primary Examiner* — Hoang Ngo
(74) *Attorney, Agent, or Firm* — Oblon, Spivak, McClelland, Maier & Neustadt, L.L.P.

(57) ABSTRACT

A fixing device includes a fixing member, a nip formation member, a pressing member, and a low-friction sheet. The nip formation member is provided inside a loop formed by the fixing member rotating in a predetermined direction of rotation. The pressing member is pressed against the nip formation member via the fixing member to form a nip between the fixing member and the pressing member through which a recording medium bearing a toner image passes. The fixing member and the pressing member rotate and convey the recording medium bearing the toner image through the nip. The low-friction sheet, over which the fixing member slides, covers the nip formation member. The nip formation member includes a first sandwiching member covered by the low-friction sheet, and a second sandwiching member sandwiching the low-friction sheet together with the first sandwiching member.

19 Claims, 8 Drawing Sheets

U.S. PATENT DOCUMENTS

| | | | |
|---|---|---|---|
| 2009/0169232 | A1 | 7/2009 | Kunii et al. |
| 2009/0245865 | A1 | 10/2009 | Shinshi et al. |
| 2009/0311016 | A1 | 12/2009 | Shinshi |
| 2010/0074667 | A1 | 3/2010 | Ehara et al. |
| 2010/0092220 | A1 | 4/2010 | Hasegawa et al. |
| 2010/0092221 | A1 | 4/2010 | Shinshi et al. |
| 2010/0202809 | A1 | 8/2010 | Shinshi et al. |

FOREIGN PATENT DOCUMENTS

| | | |
|---|---|---|
| JP | 3298354 | 4/2002 |
| JP | 2007-334205 | 12/2007 |
| JP | 2008-70747 | 3/2008 |
| JP | 2009-3410 | 1/2009 |

OTHER PUBLICATIONS

U.S. Appl. No. 12/662,991, filed May 14, 2010, Unknown.

U.S. Appl. No. 12/841,593, filed Jul. 22, 2010, Masaaki Yoshikawa, et al.

U.S. Appl. No. 12/828,612, filed Jul. 1, 2010, Masaharu Furuya, et al.

U.S. Appl. No. 12/823,770, filed Jun. 25, 2010, Kenichi Hasegawa.

* cited by examiner

FIXING DEVICE AND IMAGE FORMING APPARATUS INCORPORATING SAME

CROSS-REFERENCE TO RELATED APPLICATIONS

The present application is based on and claims priority to Japanese Patent Application No. 2009-222331, filed on Sep. 28, 2009, in the Japan Patent Office, which is hereby incorporated herein by reference in its entirety.

BACKGROUND OF THE INVENTION

1. Field of the Invention

Exemplary aspects of the present invention relate to a fixing device and an image forming apparatus, and more particularly, to a fixing device for fixing a toner image on a recording medium and an image forming apparatus including the fixing device.

2. Description of the Related Art

Related-art image forming apparatuses, such as copiers, facsimile machines, printers, or multifunction printers having at least one of copying, printing, scanning, and facsimile functions, typically form an image on a recording medium according to image data. Thus, for example, a charger uniformly charges a surface of an image carrier; an optical writer emits a light beam onto the charged surface of the image carrier to form an electrostatic latent image on the image carrier according to the image data; a development device supplies toner to the electrostatic latent image formed on the image carrier to make the electrostatic latent image visible as a toner image; the toner image is directly transferred from the image carrier onto a recording medium or is indirectly transferred from the image carrier onto a recording medium via an intermediate transfer member; a cleaner then cleans the surface of the image carrier after the toner image is transferred from the image carrier onto the recording medium; finally, a fixing device applies heat and pressure to the recording medium bearing the toner image to fix the toner image on the recording medium, thus forming the image on the recording medium.

Such fixing device may include a fixing belt or a fixing film to apply heat to the recording medium bearing the toner image. FIG. 1 is a sectional view of a fixing device 20R1 including a fixing belt 204. The fixing belt 204 is looped around a heating roller 202 and a fixing roller 203. A pressing roller 205 presses against the fixing roller 203 via the fixing belt 204 to form a fixing nip N between the pressing roller 205 and the fixing belt 204. The fixing belt 204 is heated by a heater 201 provided inside the heating roller 202. As a recording medium P bearing a toner image passes between the fixing roller 203 and the pressing roller 205 on the fixing belt 204, the fixing belt 204 and the pressing roller 205 apply heat and pressure to the recording medium P bearing the toner image to fix the toner image on the recording medium P.

One problem with such an arrangement, however, is that the heating roller 202 has a relatively large heat capacity, resulting in a longer warm-up time for the fixing device 20R1. To address this problem, instead of the fixing belt 204 the fixing device may include a fixing film having a relatively small heat capacity. FIG. 2 is a sectional view of a fixing device 20R2 including a fixing film 213. A pressing roller 212 presses against a ceramic heater 211 provided inside a loop formed by the fixing film 213 via the fixing film 213 to form a fixing nip N between the pressing roller 212 and the fixing film 213. As a recording medium bearing a toner image passes between the pressing roller 212 and the fixing film 213, the fixing film 213 heated by the ceramic heater 211 and the pressing roller 212 apply heat and pressure to the recording medium bearing the toner image to fix the toner image on the recording medium.

However, the fixing film 213 also has a drawback in that, over time, friction between the ceramic heater 211 and the fixing film 213 sliding over the ceramic heater 211 increases, resulting eventually in unstable movement of the fixing film 213 and increasing the required driving torque of the fixing device 20R2. Further, the rotating fixing film 213 is heated by the ceramic heater 211 only locally, that is, at the fixing nip N, and therefore the fixing film 213 is at its lowest temperature just before entering the fixing nip N in a direction of rotation of the fixing film 213. Accordingly, when the fixing film 213 is rotated at high speed, the fixing film 213 passing through the fixing nip N may not have a proper fixing temperature, resulting in faulty image fixing.

To address the above-described problems, the fixing device may include a pipe-shaped metal member provided inside the fixing belt, with a slight gap provided between the fixing belt and the pipe-shaped metal member. A heater provided inside the pipe-shaped metal member heats the pipe-shaped metal member, which in turn heats the fixing belt, to maintain the fixing belt at the proper temperature.

Typically, in the case of fixing devices employing either a fixing belt or a fixing film, at the fixing nip a nip formation member is provided in a concavity formed in one side of the pipe-shaped metal member and pressed against the pressing roller via the fixing belt so as to provide a nip of sufficient length. The nip formation member is formed of rubber to absorb slight surface asperities of the recording medium passing through the fixing nip. However, when the rotating fixing belt slides over the stationary nip formation member formed of rubber, a substantial amount of friction may be generated between the fixing belt and the nip formation member.

To address this problem, a low-friction sheet may be used to cover the nip formation member to reduce the friction between the fixing belt and the nip formation member. However, the low-friction sheet needs to be attached to the nip formation member securely to resist a shearing force applied by the rotating fixing belt. For example, the low-friction sheet may be attached to the nip formation member with a plurality of screws. However, such an arrangement increases the number of component parts and thus complicates assembly of the fixing device, resulting in increased manufacturing and maintenance costs.

BRIEF SUMMARY OF THE INVENTION

This specification describes below an improved fixing device. In one exemplary embodiment of the present invention, the fixing device, which fixes a toner image on a recording medium, includes a flexible endless fixing member, a nip formation member, a pressing member, and a low-friction sheet. The fixing member rotates in a predetermined direction of rotation, and is formed into a loop. The nip formation member is provided inside the loop formed by the fixing member. The pressing member is pressed against the nip formation member via the fixing member to form a nip between the fixing member and the pressing member through which the recording medium bearing the toner image passes. The fixing member and the pressing member rotate and convey the recording medium bearing the toner image through the nip. The low-friction sheet, over which the fixing member slides, covers the nip formation member. The nip formation member includes a first sandwiching member covered by the low-friction sheet, and a second sandwiching member sandwiching the low-friction sheet together with the first sandwiching member.

This specification further describes below an image forming apparatus. In one exemplary embodiment, the image forming apparatus includes an image forming device that forms a toner image on a recording medium and the fixing device described above.

BRIEF DESCRIPTION OF THE DRAWINGS

A more complete appreciation of the invention and the many attendant advantages thereof will be readily obtained as the same becomes better understood by reference to the following detailed description when considered in connection with the accompanying drawings, wherein.

DETAILED DESCRIPTION OF THE INVENTION

Figure 1:
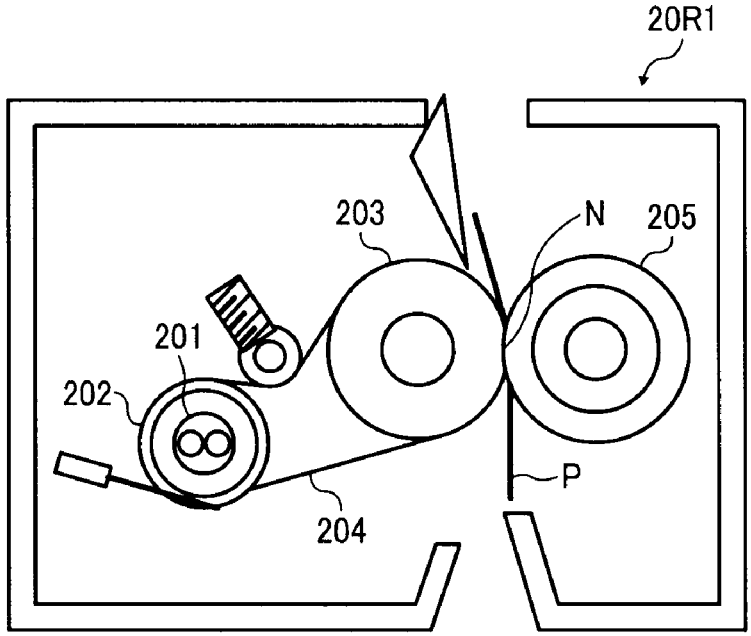
FIG. 1 RELATED ART
FIG. 1 is a sectional view of one related-art fixing device.
Figure 2:
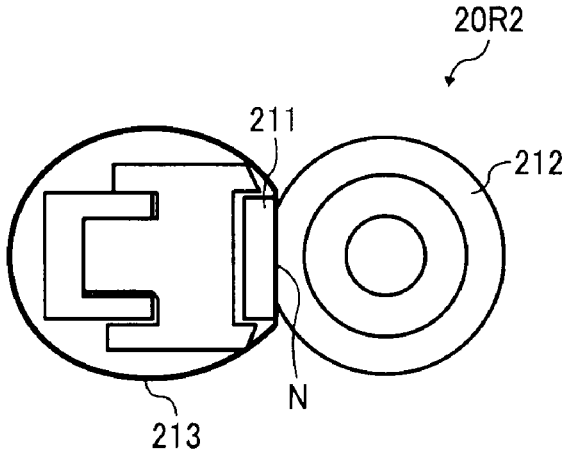
FIG. 2 RELATED ART
FIG. 2 is a sectional view of another related-art fixing device.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner.

Figure 3:
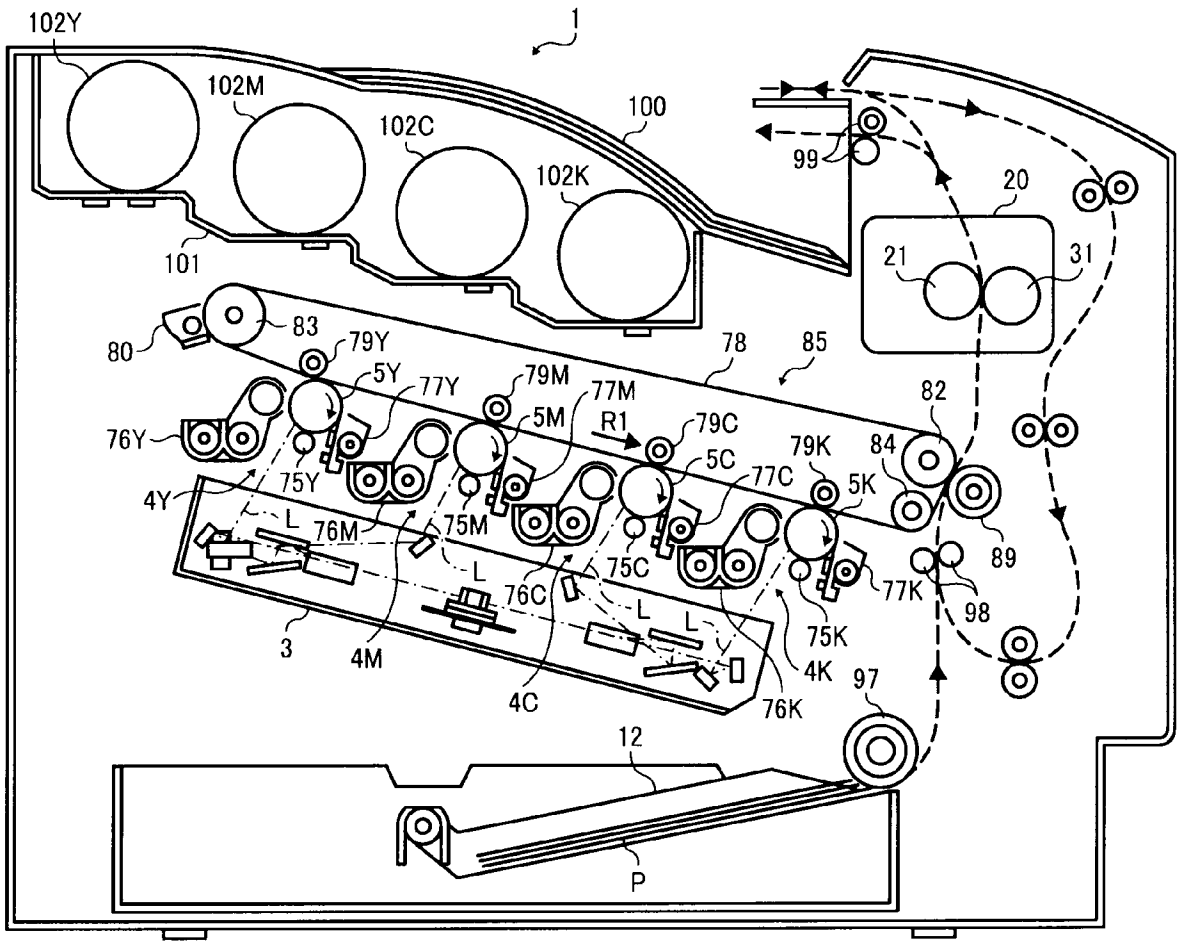
FIG. 3 is a schematic view of an image forming apparatus according to an exemplary embodiment of the present invention.

Referring now to the drawings, wherein like reference numerals designate identical or corresponding parts throughout the several views, in particular to FIG. 3, an image forming apparatus 1 according to an exemplary embodiment of the present invention is explained.

FIG. 3 is a schematic view of the image forming apparatus 1. As illustrated in FIG. 3, the image forming apparatus 1 may be a copier, a facsimile machine, a printer, a multifunction printer having at least one of copying, printing, scanning, plotter, and facsimile functions, or the like. According to this exemplary embodiment of the present invention, the image forming apparatus 1 is a tandem color printer for forming a color image on a recording medium by electrophotography or electrostatic recording.

As illustrated in FIG. 3, the image forming apparatus 1 includes an exposure device 3, image forming devices 4Y, 4M, 4C, and 4K, a paper tray 12, a fixing device 20, an intermediate transfer unit 85, a second transfer roller 89, a feed roller 97, a registration roller pair 98, an output roller pair 99, a stack portion 100, and a toner bottle holder 101.

The image forming devices 4Y, 4M, 4C, and 4K include photoconductive drums 5Y, 5M, 5C, and 5K, chargers 75Y, 75M, 75C, and 75K, development devices 76Y, 76M, 76C, and 76K, and cleaners 77Y, 77M, 77C, and 77K, respectively.

The fixing device 20 includes a fixing belt 21 and a pressing roller 31.

The intermediate transfer unit 85 includes an intermediate transfer belt 78, first transfer bias rollers 79Y, 79M, 79C, and 79K, an intermediate transfer cleaner 80, a second transfer backup roller 82, a cleaning backup roller 83, and a tension roller 84.

The toner bottle holder 101 includes toner bottles 102Y, 102M, 102C, and 102K.

The toner bottle holder 101 is provided in an upper portion of the image forming apparatus 1. The four toner bottles 102Y, 102M, 102C, and 102K contain yellow, magenta, cyan, and black toners, respectively, and are detachably attached to the toner bottle holder 101 so that the toner bottles 102Y, 102M, 102C, and 102K are replaced with new ones, respectively.

The intermediate transfer unit 85 is provided below the toner bottle holder 101. The image forming devices 4Y, 4M, 4C, and 4K are arranged opposite the intermediate transfer belt 78 of the intermediate transfer unit 85, and form yellow, magenta, cyan, and black toner images, respectively.

In the image forming devices 4Y, 4M, 4C, and 4K, the chargers 75Y, 75M, 75C, and 75K, the development devices 76Y, 76M, 76C, and 76K, the cleaners 77Y, 77M, 77C, and 77K, and dischargers surround the photoconductive drums 5Y, 5M, 5C, and 5K, respectively. Image forming processes including a charging process, an exposure process, a development process, a first transfer process, and a cleaning process are performed on the rotating photoconductive drums 5Y, 5M, 5C, and 5K to form yellow, magenta, cyan, and black toner images on the photoconductive drums 5Y, 5M, 5C, and 5K, respectively.

The following describes the image forming processes performed on the photoconductive drums 5Y, 5M, 5C, and 5K.

A driving motor drives and rotates the photoconductive drums 5Y, 5M, 5C, and 5K clockwise in FIG. 3. In the charging process, the chargers 75Y, 75M, 75C, and 75K uniformly charge surfaces of the photoconductive drums 5Y, 5M, 5C, and 5K, respectively.

In the exposure process, the exposure device 3 emits laser beams L onto the charged surfaces of the photoconductive drums 5Y, 5M, 5C, and 5K to irradiate and expose the charged surfaces of the photoconductive drums 5Y, 5M, 5C, and 5K, respectively, so as to form thereon electrostatic latent images corresponding to yellow, magenta, cyan, and black colors, respectively.

In the development process, the development devices 76Y, 76M, 76C, and 76K render the electrostatic latent images formed on the surfaces of the photoconductive drums 5Y, 5M, 5C, and 5K visible as yellow, magenta, cyan, and black toner images, respectively.

In the first transfer process, the first transfer bias rollers 79Y, 79M, 79C, and 79K transfer and superimpose the yellow, magenta, cyan, and black toner images formed on the photoconductive drums 5Y, 5M, 5C, and 5K onto the intermediate transfer belt 78. Thus, a color toner image is formed on the intermediate transfer belt 78.

After the transfer of the yellow, magenta, cyan, and black toner images, the surfaces of the photoconductive drums 5Y, 5M, 5C, and 5K from which the yellow, magenta, cyan, and black toner images are transferred reach positions at which the cleaners 77Y, 77M, 77C, and 77K are disposed opposite the photoconductive drums 5Y, 5M, 5C, and 5K, respectively. In the cleaning process, cleaning blades included in the cleaners 77Y, 77M, 77C, and 77K mechanically collect residual toner remaining on the surfaces of the photoconductive drums 5Y, 5M, 5C, and 5K from the photoconductive drums 5Y, 5M, 5C, and 5K, respectively. Thereafter, dischargers remove residual potential on the surfaces of the photoconductive drums 5Y, 5M, 5C, and 5K, respectively, thus completing a single sequence of image forming processes performed on the photoconductive drums 5Y, 5M, 5C, and 5K.

The following describes a series of transfer processes performed on the intermediate transfer belt 78.

The intermediate transfer unit 85 includes the endless, intermediate transfer belt 78, the four first transfer bias rollers 79Y, 79M, 79C, and 79K, the second transfer backup roller 82, the cleaning backup roller 83, the tension roller 84, and the intermediate transfer cleaner 80.

The intermediate transfer belt 78 is supported by and stretched over the second transfer backup roller 82, the cleaning backup roller 83, and the tension roller 84. The second transfer backup roller 82 drives and rotates the intermediate transfer belt 78 in a direction R1.

The first transfer bias rollers 79Y, 79M, 79C, and 79K and the photoconductive drums 5Y, 5M, 5C, and 5K sandwich the intermediate transfer belt 78 to form first transfer nips, respectively. The first transfer bias rollers 79Y, 79M, 79C, and 79K are applied with a transfer bias having a polarity opposite to a polarity of toner forming the yellow, magenta, cyan, and black toner images on the photoconductive drums 5Y, 5M, 5C, and 5K, respectively.

As the intermediate transfer belt 78 moves in the direction R1 and passes through the first transfer nips formed between the intermediate transfer belt 78 and the photoconductive drums 5Y, 5M, 5C, and 5K successively, the yellow, magenta, cyan, and black toner images formed on the photoconductive drums 5Y, 5M, 5C, and 5K, respectively, are transferred and superimposed onto the intermediate transfer belt 78. Thus, a color toner image is formed on the intermediate transfer belt 78.

The paper tray 12 is provided in a lower portion of the image forming apparatus 1, and loads a plurality of recording media P (e.g., transfer sheets). The feed roller 97 rotates counterclockwise in FIG. 3 to feed an uppermost recording medium P of the plurality of recording media P loaded on the paper tray 12 toward the registration roller pair 98.

The registration roller pair 98, which stops rotating temporarily, stops the uppermost recording medium P fed by the feed roller 97. For example, a roller nip of the registration roller pair 98 contacts and stops a leading edge of the recording medium P temporarily. The registration roller pair 98 resumes rotating to feed the recording medium P to a second transfer nip formed between the second transfer roller 89 and the intermediate transfer belt 78, as the color toner image formed on the intermediate transfer belt 78 reaches the second transfer nip.

After the first transfer process, an outer circumferential surface of the intermediate transfer belt 78 bearing the color toner image reaches a position at which the second transfer roller 89 is disposed opposite the intermediate transfer belt 78. At this position, the second transfer roller 89 and the second transfer backup roller 82 sandwich the intermediate transfer belt 78 to form the second transfer nip between the second transfer roller 89 and the intermediate transfer belt 78. At the second transfer nip, the second transfer roller 89 transfers the color toner image formed on the intermediate transfer belt 78 onto the recording medium P fed by the registration roller pair 98 in a second transfer process. After the second transfer process, when the outer circumferential surface of the intermediate transfer belt 78 reaches a position at which the intermediate transfer cleaner 80 is disposed opposite the intermediate transfer belt 78, the intermediate transfer cleaner 80 collects residual toner from the intermediate transfer belt 78, thus completing a single sequence of transfer processes performed on the intermediate transfer belt 78.

The recording medium P bearing the color toner image is sent to the fixing device 20. In the fixing device 20, the fixing belt 21 and the pressing roller 31 apply heat and pressure to the recording medium P to fix the color toner image on the recording medium P.

Thereafter, the fixing device 20 feeds the recording medium P bearing the fixed color toner image toward the output roller pair 99. The output roller pair 99 discharges the recording medium P to an outside of the image forming apparatus 1, that is, the stack portion 100. Thus, the recording media P discharged by the output roller pair 99 are stacked on the stack portion 100 successively to complete a single sequence of image forming processes performed by the image forming apparatus 1.

Figure 4:
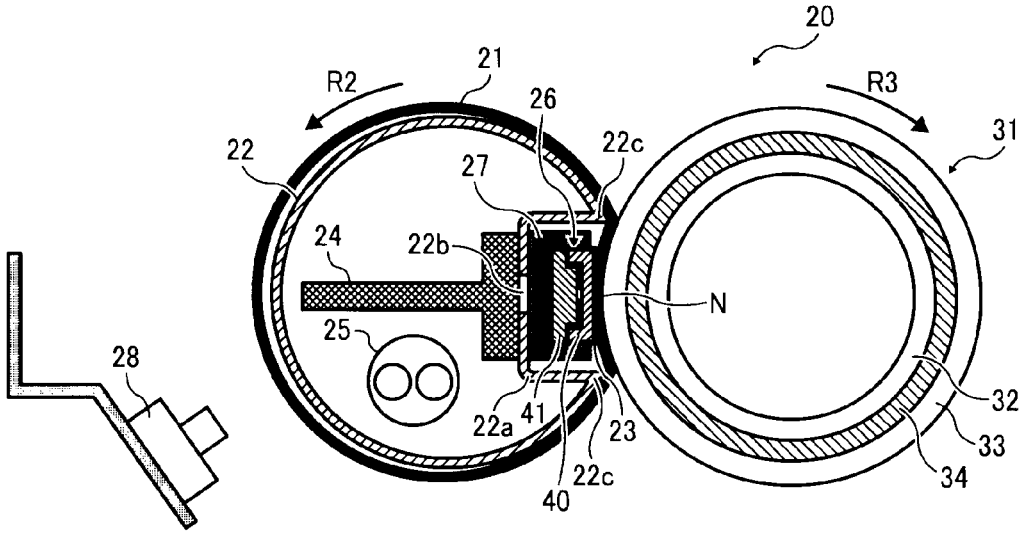
FIG. 4 is a sectional view of a fixing device included in the image forming apparatus shown in FIG. 3.

FIG. 4 is a sectional view of the fixing device 20. As illustrated in FIG. 4, the fixing device 20 further includes a holding member 22, a low-friction sheet 23, a support member 24, a halogen heater 25, a nip formation member 26, a heat insulator 27, and a temperature sensor 28. The holding member 22 includes a concave portion 22*a*, an opening 22*b*, and corner portions 22*c*. The nip formation member 26 includes a rubber pad 40 and a sheet holder 41. The pressing roller 31 includes a metal core 32, a release layer 33, and an elastic layer 34.

As illustrated in FIG. 4, in the fixing device 20, the fixing belt 21 (e.g., a flexible endless belt) serves as a fixing member. The substantially pipe-shaped or cylindrical, metal holding member 22 is provided inside a loop formed by the fixing belt 21. The holding member 22 contacts an inner circumferential surface of the fixing belt 21 to support the fixing belt 21 and maintain the loop shape of the fixing belt 21. The halogen heater 25 serves as a heater that heats the holding member 22. The temperature sensor 28 serves as a non-contact temperature detector provided opposite an outer circumferential surface of the fixing belt 21 to detect a temperature of the outer circumferential surface of the fixing belt 21. The pressing roller 31 serves as a pressing member that contacts the outer circumferential surface of the fixing belt 21 to form a fixing nip N between the pressing roller 31 and the fixing belt 21.

The concave portion 22*a* of the holding member 22 faces the fixing nip N. The nip formation member 26, the low-friction sheet 23, and the heat insulator 27 are provided in the concave portion 22*a*. The nip formation member 26 is pressed against the pressing roller 31 via the fixing belt 21 to form the fixing nip N between the pressing roller 31 and the fixing belt 21. The porous low-friction sheet 23 including polytetrafluoroethylene (PTFE) resin is provided between the fixing belt 21 and the nip formation member 26. The heat insulator 27 is provided between a bottom of the concave portion 22*a* of the holding member 22 and the nip formation member 26. Thus, the holding member 22 maintains the nip formation member 26 at a predetermined position. A pressing surface of the T-shaped support member 24 facing the fixing nip N contacts an inner surface of the concave portion 22*a* facing the support member 24.

According to this exemplary embodiment, the nip formation member 26 has a concave shape facing the fixing nip N. Alternatively, the nip formation member 26 may have a planar shape or other suitable shape to face the fixing nip N. However, the concave shape of the nip formation member 26 is able to direct a leading edge of a recording medium P exiting the fixing nip N toward the pressing roller 31, thus facilitating separation of the recording medium P from the fixing belt 21 and suppressing jamming of the recording medium P.

The pressing roller 31 is constructed of the metal core 32, that is, a hollow metal roller; the elastic layer 34 (e.g., a silicon rubber layer) surrounding the metal core 32; and the release layer 33 surrounding the elastic layer 34, serving as an outer circumferential layer that facilitates separation of the recording medium P from the pressing roller 31. The release layer 33 may be a resin layer including perfluoroalkylvinylether copolymer (PFA) and/or PTFE.

A driver (e.g., a motor) provided in the image forming apparatus 1 depicted in FIG. 3 transmits a driving force to the pressing roller 31 via a gear train to drive and rotate the pressing roller 31. A biasing member, such as a spring, presses the pressing roller 31 against the fixing belt 21. In other words, the spring presses the release layer 33 and the elastic layer 34 of the pressing roller 31 against the nip formation member 26, deforming the release layer 33 and the elastic layer 34 so as to form the fixing nip N with a predetermined nip length.

It is to be noted that, alternatively, the pressing roller 31 may be a solid roller. However, a hollow roller, with its smaller heat capacity, is preferable. Further, a heat source (e.g., a halogen heater) may be provided inside the pressing roller 31.

The elastic layer 34 of the pressing roller 31 may include solid rubber. Alternatively, when a heat source such as a heater is not provided inside the pressing roller 31, the elastic layer 34 may preferably include sponge rubber to improve heat insulation to suppress heat transmission from the fixing belt 21 to the pressing roller 31.

The fixing belt 21 may be a metal belt including nickel and/or stainless steel, or an endless belt or an endless film including a resin material such as polyimide. The fixing belt 21 may include a release layer as a surface layer, that is, a resin layer including PFA and/or PTFE, to prevent the toner image on the recording medium P from adhering to the fixing belt 21, thus facilitating separation of the recording medium P bearing the toner image from the fixing belt 21.

The fixing belt 21 may further include a base layer, and an intermediate elastic layer (e.g., a silicon rubber layer) provided between the base layer and the release layer. If the elastic layer is not provided, the fixing belt 21 has a smaller heat capacity, improving fixing property. However, the fixing belt 21 without the elastic layer may crush an unfixed toner image on the recording medium P, generating slight surface asperities in the fixing belt 21 that in turn are transferred to a solid toner image on the recording medium P. As a result, a rough toner image having the appearance of an orange peel may be formed on the recording medium P. To address this problem, the elastic layer needs to have a thickness of not less than 100 μm. Such a thick elastic layer deforms to absorb slight surface asperities of the fixing belt 21, suppressing the orange-peel effect.

The hollow holding member 22 may be a metal pipe including aluminum, iron, and/or stainless steel. According to this exemplary embodiment, the holding member 22 has a circular shape in cross-section. Alternatively, the holding member 22 may have a square shape or some other suitable shape in cross-section.

The support member 24 is provided inside the holding member 22 to support the nip formation member 26 that forms the fixing nip N between the fixing belt 21 and the pressing roller 31. In order to prevent radiation heat generated by the halogen heater 25 from heating the support member 24, a surface of the support member 24 may be insulated or mirror-finished to suppress energy absorption.

The holding member 22 heated by the halogen heater 25 transmits heat to the fixing belt 21. According to this exemplary embodiment, the halogen heater 25 is used as a heat source that heats the holding member 22. Alternatively, an induction heater (IH), a resistance heat generator, or a carbon heater may be used as a heat source that heats the holding member 22.

The fixing belt 21 rotates in accordance with rotation of the pressing roller 31. Specifically, the driver described above rotates the pressing roller 31, and a driving force is transmitted from the pressing roller 31 to the fixing belt 21 at the fixing nip N to rotate the fixing belt 21 in a circumferential direction.

At the fixing nip N, the fixing belt 21 is sandwiched between the nip formation member 26 and the pressing roller 31, and is rotated by the rotating pressing roller 31. By contrast, at a position other than the fixing nip N, the fixing belt 21 is guided by the holding member 22 in such a manner that the fixing belt 21 does not separate from the holding member 22, serving as a heat conductor, by more than a predetermined distance.

A lubricant such as silicon oil or fluorine grease is applied between the fixing belt 21 and the holding member 22 so that the fixing belt 21 slides over the holding member 22 smoothly.

In the fixing device 20 having the above-described structure, the holding member 22 diffuses heat to apply heat to the entire fixing belt 21 uniformly, stabilizing the temperature of the entire fixing belt 21. Thus, the fixing device 20 is warmed up quickly at reduced costs.

The following describes the nip formation member 26.

The nip formation member 26 is required to provide low friction to reduce torque of the components forming the fixing nip N, and provide elasticity to form a proper toner image on the recording medium P without disturbing movement of the recording medium P passing through the fixing nip N. To satisfy these requirements, the nip formation member 26 includes the rubber pad 40 (e.g., a fluorocarbon or silicon rubber pad) to provide elasticity, and the low-friction sheet 23 including PTFE is wrapped around a surface of the nip formation member 26 to provide low friction.

The rotating fixing belt 21 continuously applies a shearing force to a downstream portion of the low-friction sheet 23 provided downstream from a center of the fixing nip N in a rotation direction R2 of the fixing belt 21. In order to make the low-friction sheet 23 act as a stable surface of the nip formation member 26, the low-friction sheet 23 needs to be securely attached to the rubber pad 40 of the nip formation member 26. However, if lots of screws are used to attach the low-friction sheet 23 to the nip formation member 26, the fixing device 20 experiences an increase in the number of parts and therefore may not be assembled easily, resulting in increased manufacturing costs.

To address this problem, in the fixing device 20 according to this exemplary embodiment, the nip formation member 26 has the structure described below.

Figure 5A:
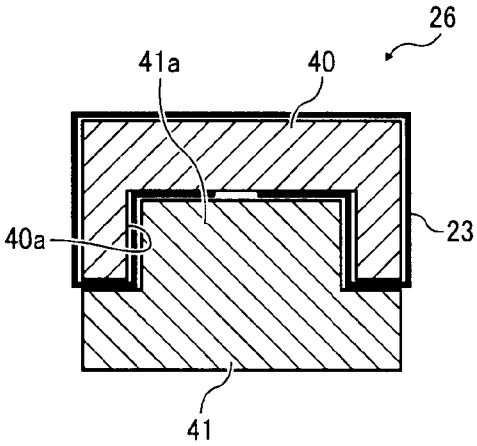
FIG. 5A is a sectional view of a nip formation member included in the fixing device shown in FIG. 4 after assembly of the nip formation member is finished.
Figure 5B:
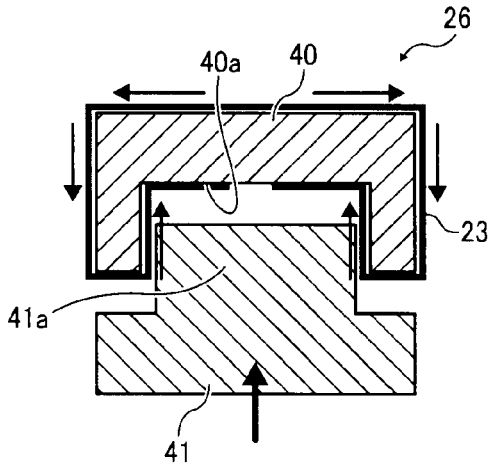
FIG. 5B is a sectional view of the nip formation member shown in FIG. 5A before assembly of the nip formation member is finished.

FIG. 5A is a sectional view of the nip formation member 26 after the sheet holder 41 engages the rubber pad 40. FIG. 5B is a sectional view of the nip formation member 26 before the sheet holder 41 engages the rubber pad 40. As illustrated in FIGS. 5A and 5B, the rubber pad 40 includes a concave portion 40*a*. The sheet holder 41 includes a convex portion 41*a*.

The rubber pad 40 faces the fixing nip N. The concave portion 40*a* serves as a lower surface portion of the rubber pad 40 in FIG. 5A. The convex portion 41*a* serves as an upper surface portion of the sheet holder 41 (e.g., a metal plate) in FIG. 5A, and engages the concave portion 40*a* of the rubber pad 40.

As illustrated in FIG. 5B, the low-friction sheet 23 is wrapped around and covers an outer circumferential surface portion of the rubber pad 40. Accordingly, when the convex portion 41*a* of the sheet holder 41 is pressed into and engages the concave portion 40*a* of the rubber pad 40, the low-friction sheet 23 wrapped around the rubber pad 40 is securely attached to the nip formation member 26.

Figure 6:
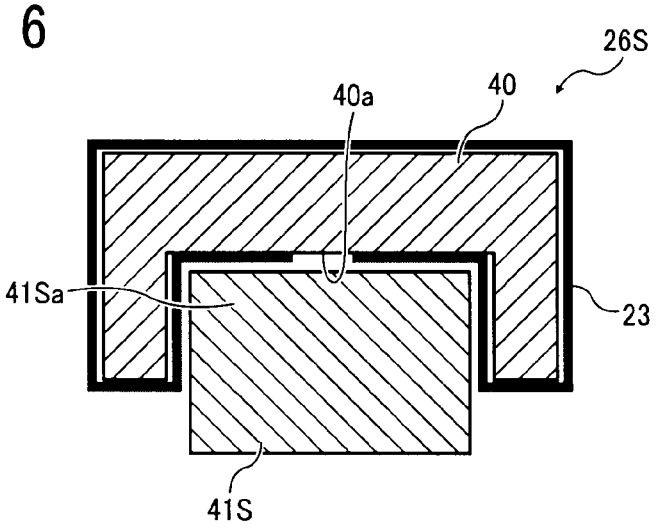
FIG. 6 is a sectional view of a nip formation member as one variation of the nip formation member shown in FIG. 5A.

FIG. 6 is a sectional view of a nip formation member 26S as one variation of the nip formation member 26 depicted in FIG. 5A. As illustrated in FIG. 6, the nip formation member 26S includes the rubber pad 40 and a sheet holder 41S. The sheet holder 41S includes a rectangular portion 41Sa.

The sheet holder 41S (e.g., a metal plate) has a rectangular shape in cross-section. The rectangular portion 41Sa serves as an upper portion of the sheet holder 41S in FIG. 6 and faces the concave portion 40*a* of the rubber pad 40. The rectangular portion 41Sa of the sheet holder 41S is pressed into and engages the concave portion 40*a* of the rubber pad 40.

Figure 7:
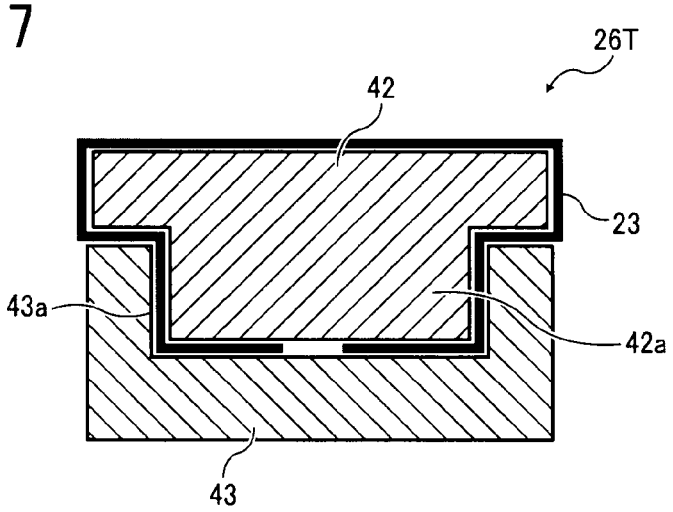
FIG. 7 is a sectional view of a nip formation member according to another exemplary embodiment of the present invention.

FIG. 7 is a sectional view of a nip formation member 26T according to another exemplary embodiment. As illustrated in FIG. 7, the nip formation member 26T includes a rubber pad 42 and a sheet holder 43. The rubber pad 42 includes a convex portion 42*a*. The sheet holder 43 includes a concave portion 43*a*.

The rubber pad 42 faces the fixing nip N. The convex portion 42*a* serves as a lower surface portion of the rubber pad 42 in FIG. 7. The concave portion 43*a* serves as an upper surface portion of the sheet holder 43 (e.g., a metal plate) in FIG. 7, and engages the convex portion 42*a* of the rubber pad 42.

As illustrated in FIG. 7, the low-friction sheet 23 covers an outer circumferential surface portion of the rubber pad 42. Accordingly, when the concave portion 43*a* of the sheet holder 43 engages the convex portion 42*a* of the rubber pad 42, the low-friction sheet 23 wrapped around the rubber pad 42 is securely attached to the nip formation member 26T.

Figure 8:
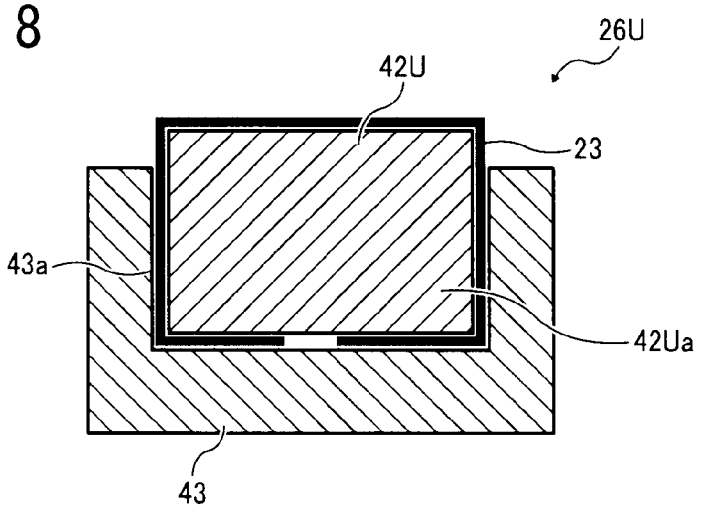
FIG. 8 is a sectional view of a nip formation member as one variation of the nip formation member shown in FIG. 7.

FIG. 8 is a sectional view of a nip formation member 26U as one variation of the nip formation member 26T depicted in FIG. 7. As illustrated in FIG. 8, the nip formation member 26U includes a rubber pad 42U and the sheet holder 43. The rubber pad 42U includes a rectangular portion 42Ua.

The rubber pad 42U has a rectangular shape in cross-section. The rectangular portion 42Ua serves as a lower portion of the rubber pad 42U in FIG. 8 and faces the concave portion 43*a* of the sheet holder 43. The rectangular portion 42Ua of the rubber pad 42U is pressed into and engages the concave portion 43*a* of the sheet holder 43.

As described above, the nip formation member 26, 26S, 26T, or 26U serves as a unit in which the low-friction sheet 23 is attached to the rubber pad 40, 42, or 42U without using a fastener such as a screw in such a manner that the low-friction sheet 23 is wrapped around the rubber pad 40, 42, or 42U. The low-friction sheet 23 is sandwiched between the rubber pad 40, 42, or 42U and the sheet holder 41, 41S, or 43, and is fixed between the rubber pad 40, 42, or 42U and the sheet holder 41, 41S, or 43 precisely.

In the nip formation member 26 or 26S depicted in FIG. 5A or 6, respectively, the low-friction sheet 23 is fixed to the rubber pad 40 more securely than in the nip formation member 26T or 26U depicted in FIG. 7 or 8, respectively.

Specifically, when the sheet holder 41 or 41S engages the rubber pad 40 via the low-friction sheet 23, a frictional force applied between the sheet holder 41 or 41S and the low-friction sheet 23 fixes the low-friction sheet 23 to the nip formation member 26 in a state in which tension is applied to the low-friction sheet 23 as illustrated in FIG. 5B. Thus, when the sheet holder 41 or 41S engages the rubber pad 40, the low-friction sheet 23 is fixed to the rubber pad 40 more securely.

Referring to FIGS. 9 to 13, the following describes a nip formation member 26V according to yet another exemplary embodiment.

Figure 9:
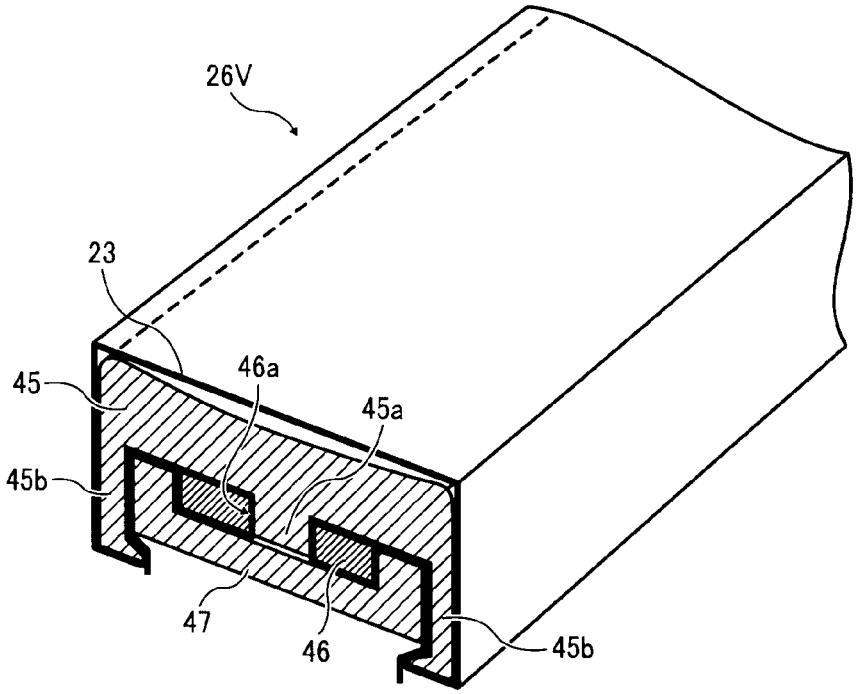
FIG. 9 is a partial perspective view of a nip formation member according to yet another exemplary embodiment of the present invention.

FIG. 9 is a partial perspective view of the nip formation member 26V. As illustrated in FIG. 9, the nip formation member 26V includes a rubber pad 45, an inner sheet holder 46, and an outer sheet holder 47. The rubber pad 45 includes a protrusion 45*a* and hook portions 45*b*. The inner sheet holder 46 includes a slit 46*a*.

Figure 10:
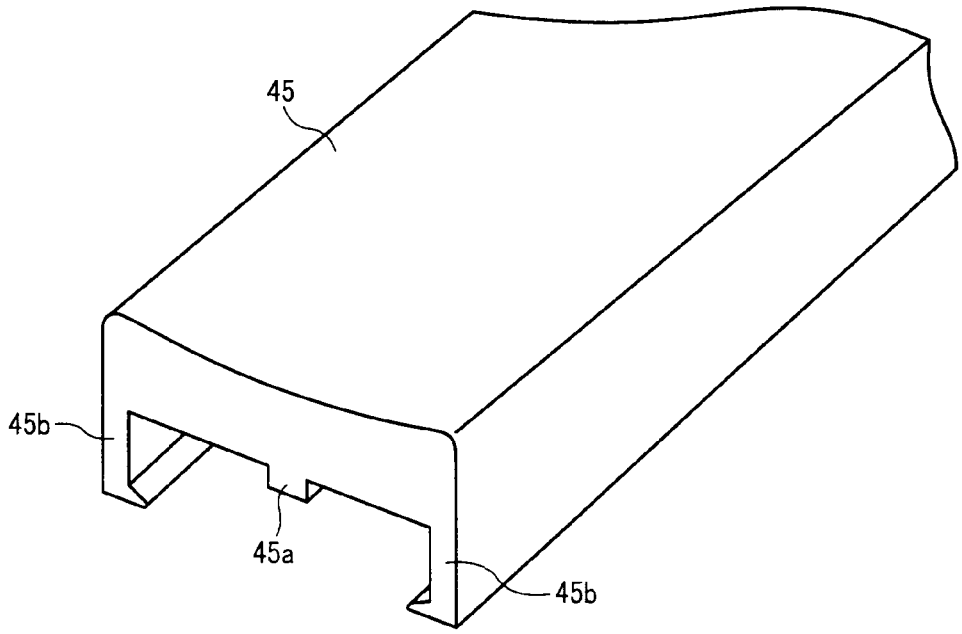
FIG. 10 is a partial perspective view of a rubber pad included in the nip formation member shown in FIG. 9.

FIG. 10 is a partial perspective view of the rubber pad 45. The protrusion 45*a* is provided on a center of a lower face of the rubber pad 45 in a short direction of the rubber pad 45. The hook portions 45*b* are provided on lateral edges of the lower face of the rubber pad 45 in the short direction of the rubber pad 45, respectively, and serve as legs protruding from the lower face of the rubber pad 45.

Figure 11:
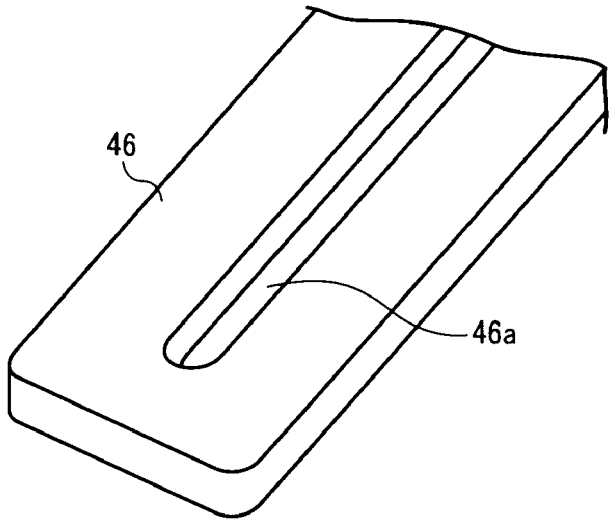
FIG. 11 is a partial perspective view of an inner sheet holder included in the nip formation member shown in FIG. 9.

FIG. 11 is a partial perspective view of the inner sheet holder 46. The inner sheet holder 46 is a metal plate. The slit 46*a* penetrating the inner sheet holder 46 is provided in a center of the inner sheet holder 46 in a short direction of the inner sheet holder 46 and extends along a longitudinal direction of the inner sheet holder 46 perpendicular to the short direction of the inner sheet holder 46.

Figure 12:
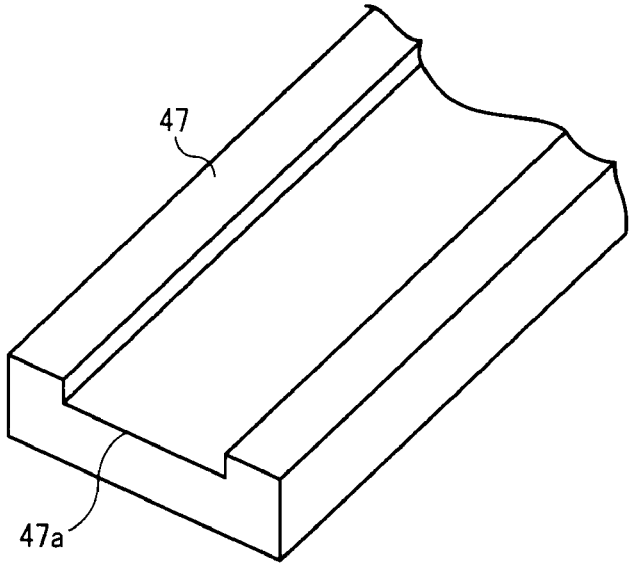
FIG. 12 is a partial perspective view of an outer sheet holder included in the nip formation member shown in FIG. 9.

FIG. 12 is a partial perspective view of the outer sheet holder 47. The outer sheet holder 47 includes a concave portion 47*a*. Like the inner sheet holder 46, the outer sheet holder 47 is a metal plate. The outer sheet holder 47 is U-like shaped in cross-section and includes the concave portion 47*a* provided at a center of the outer sheet holder 47 in a short direction of the outer sheet holder 47.

Figure 13:
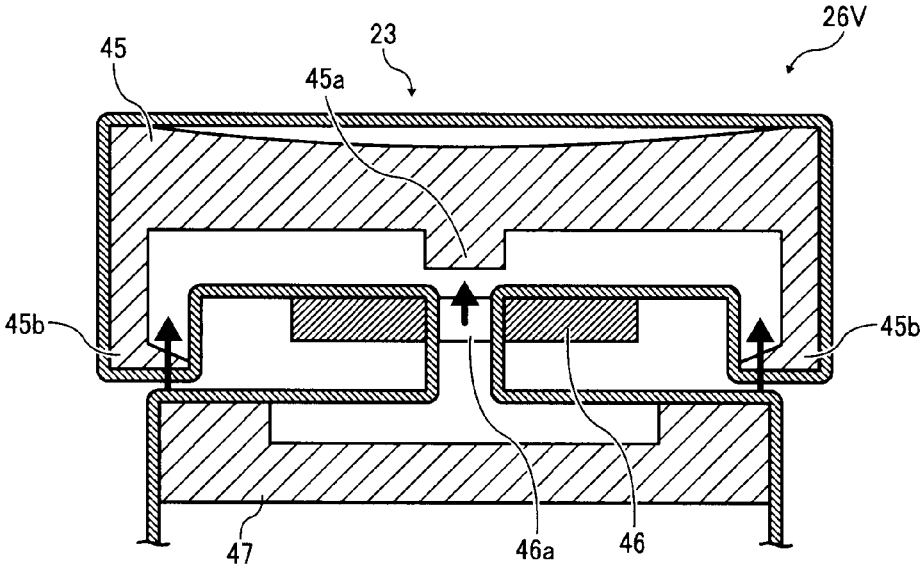
FIG. 13 is a sectional view of the nip formation member shown in FIG. 9 during assembly of the nip formation member.

FIG. 13 is a sectional view of the nip formation member 26V during assembly of the nip formation member 26V. The following describes assembly processes of the nip formation member 26V.

The low-friction sheet 23 is wrapped around an outer circumferential surface portion of the rubber pad 45 and drawn through the slit 46*a* of the inner sheet holder 46. When both ends of the low-friction sheet 23 are pulled, slack of the low-friction sheet 23 is reduced and therefore the low-friction sheet 23 is closely adhered to the rubber pad 45. The protrusion 45*a* of the rubber pad 45 is pressed into the slit 46*a* of the inner sheet holder 46 to engage the slit 46*a*.

The low-friction sheet 23 is spread outward from the slit 46*a* to cover an outer surface portion of the outer sheet holder 47. The outer sheet holder 47 covered by the low-friction sheet 23 is pressed into a space sandwiched by the hook portions 45*b* of the rubber pad 45 to engage the rubber pad 45.

FIG. 9 illustrates a sectional view of the nip formation member 26V after assembly of the nip formation member 26V is finished. The low-friction sheet 23 is wrapped around the rubber pad 45, the inner sheet holder 46, and the outer sheet holder 47 along a winding path formed between the rubber pad 45 and the outer sheet holder 47, between the rubber pad 45 and the inner sheet holder 46, and between the inner sheet holder 46 and the outer sheet holder 47. The winding path is bent at a plurality of positions to form a labyrinth. Accordingly, the low-friction sheet 23 is attached to a surface of the rubber pad 45 securely without a fastener such as a screw.

The inner sheet holder 46 and the outer sheet holder 47 are secured by the protrusion 45*a* and the hook portions 45*b* of the rubber pad 45. Accordingly, even when a shearing force is applied to the inner sheet holder 46 and the outer sheet holder 47, the inner sheet holder 46 and the outer sheet holder 47 remain unaffected and do not shift.

Further, the low-friction sheet 23 is removed easily by pulling the outer sheet holder 47 in a direction opposite a direction in which the outer sheet holder 47 is pressed into the space sandwiched by the hook portions 45*b* of the rubber pad 45, facilitating replacement of the low-friction sheet 23 for maintenance. Consequently, the nip formation member 26V covered by the low-friction sheet 23 is manufactured at reduced costs, and maintenance of the nip formation member 26V is simplified and performed at reduced costs.

According to the above-described exemplary embodiments, the fixing belt 21 is indirectly heated by the halogen heater 25 via the holding member 22 as illustrated in FIG. 4. Alternatively, the fixing belt 21 may be heated directly.

Figure 14:
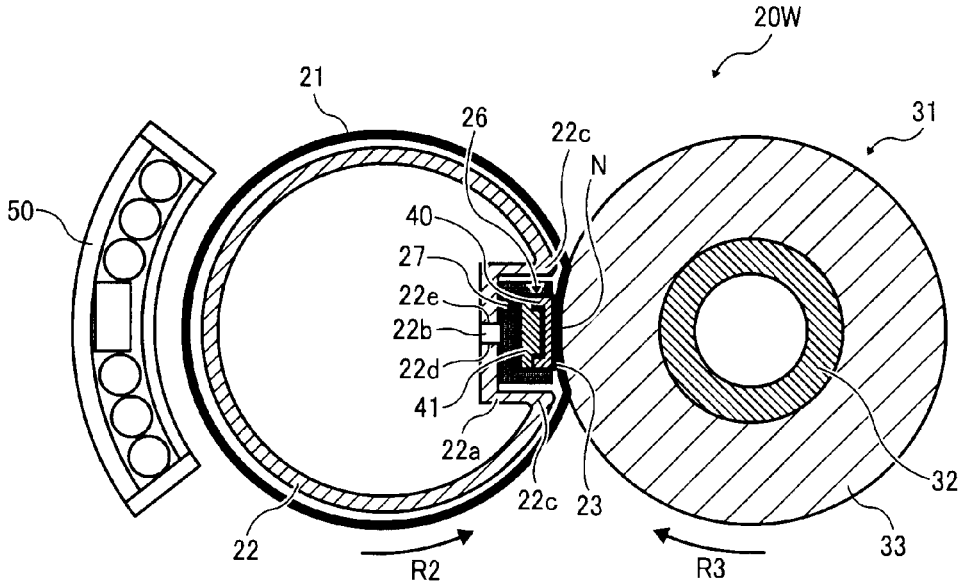
FIG. 14 is a sectional view of a fixing device according to yet another exemplary embodiment of the present invention.

FIG. 14 is a sectional view of a fixing device 20W according to yet another exemplary embodiment. As illustrated in FIG. 14, the fixing device 20W includes an induction heater 50. The holding member 22 further includes an upstream edge 22*d* and a downstream edge 22*e*. The induction heater 50 replaces the halogen heater 25 depicted in FIG. 4. The other elements of the fixing device 20W are equivalent to the elements of the fixing device 20 depicted in FIG. 4.

The fixing device 20W includes the induction heater 50 instead of the halogen heater 25 depicted in FIG. 4. The induction heater 50 is provided outside the loop formed by the fixing belt 21 to face the outer circumferential surface of the fixing belt 21, and serves as a heater for heating the fixing belt 21 by using electromagnetic induction of induction heating (IH).

The induction heater 50 includes an exciting coil, a core, and a coil guide. The exciting coil includes litz wires formed of bundled thin wires and extended in a width direction, that is, an axial direction, of the fixing belt 21 to cover a part of the fixing belt 21. The coil guide includes heat-resistant resin and holds the exciting coil and the core. The core is a semi-cylindrical member formed of a ferromagnet (e.g., ferrite) having relative magnetic permeability in a range of from about 1,000 to about 3,000. The core includes a center core and a side core to generate magnetic fluxes toward the holding member 22 effectively. The core is disposed opposite the exciting coil extending in the width direction of the fixing belt 21.

The following describes operation of the fixing device 20W including the induction heater 50 having the above-described structure.

When the fixing belt 21 rotates in the rotation direction R2, the induction heater 50 heats the fixing belt 21 at a position at which the fixing belt 21 faces the induction heater 50. Specifically, a high-frequency alternating current is applied to the exciting coil to generate magnetic lines of force around the holding member 22 in such a manner that the magnetic lines of force are alternately switched back and forth. Accordingly, an eddy current generates on the surface of the holding member 22, and electric resistance of the holding member 22 generates Joule heat. The Joule heat heats the holding member 22 by electromagnetic induction, and the heated holding member 22 heats the fixing belt 21.

In order to heat the holding member 22 effectively by electromagnetic induction, the induction heater 50 may face the holding member 22 in an entire circumferential direction of the holding member 22. The holding member 22 may include nickel, stainless steel, iron, copper, cobalt, chrome, aluminum, gold, platinum, silver, tin, palladium, an alloy of a plurality of those metals, and/or the like.

The holding member 22 contacts or faces the inner circumferential surface of the fixing belt 21 to support or hold the fixing belt 21 and to heat the fixing belt 21. The holding member 22 may be manufactured by bending a thin sheet metal into a pipe shape at relatively reduced manufacturing costs, improving heating efficiency for heating the fixing belt 21, shortening a warm-up time or a first print time, and suppressing faulty fixing which may occur when the fixing device 20W is driven at high speed.

Figure 15:
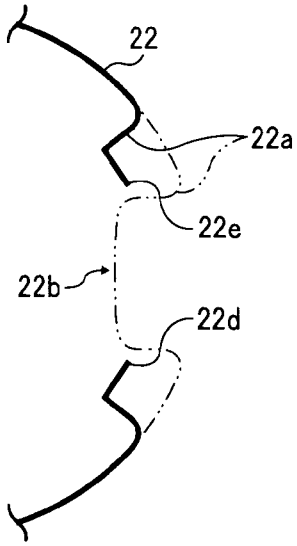
FIG. 15 is a partially enlarged view of a holding member included in the fixing device shown in FIG. 14.

FIG. 15 is a partially enlarged view of the holding member 22. If the thin sheet metal is bent into the pipe shape in such a manner that the upstream edge 22*d* of the holding member 22 provided upstream from the fixing nip N in the rotation direction R2 of the fixing belt 21 (depicted in FIG. 14) is separated from the downstream edge 22*e* of the holding member 22 provided downstream from the fixing nip N, the inherent spring-back of the thin sheet metal may enlarge the opening 22*b* between the upstream edge 22*d* and the downstream edge 22*e* as illustrated in FIG. 15. Accordingly, the holding member 22 may not contact or press against the fixing belt 21 with uniform pressure.

To address this problem, at least a part of the upstream edge 22*d* in a width direction, that is, an axial direction, of the holding member 22 may be combined with the downstream edge 22*e* to prevent the spring-back of the holding member 22 from enlarging the opening 22*b* between the upstream edge 22*d* and the downstream edge 22*e*. For example, the upstream edge 22*d* may be combined with the downstream edge 22*e* by welding.

In the holding member 22, the corner portions 22*c* (depicted in FIG. 14) are provided in the concave portion 22*a* housing the nip formation member 26. If the corner portions 22*c* and the vicinity thereof press against the pressing roller 31 via the fixing belt 21, pressure applied by the pressing roller 31 may deform the holding member 22. Accordingly, the holding member 22 may not contact or press against the fixing belt 21 with uniform pressure.

To address this problem, the holding member 22 including the corner portions 22*c* does not press against the pressing roller 31 via the fixing belt 21. For example, the corner portions 22*c* are provided at positions separated from the fixing nip N so that the corner portions 22*c* are separated from the pressing roller 31.

Figure 16:
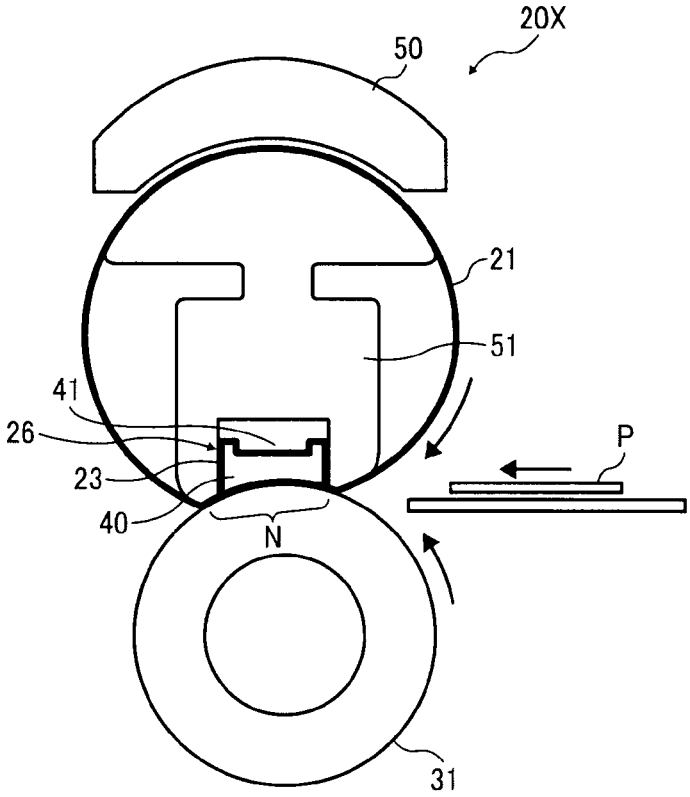
FIG. 16 is a sectional view of a fixing device according to yet another exemplary embodiment of the present invention.

In the fixing device 20W, the induction heater 50 heats the fixing belt 21 via the holding member 22. Alternatively, the induction heater 50 may heat the fixing belt 21 directly. FIG. 16 is a sectional view of a fixing device 20X including the induction heater 50 that heats the fixing belt 21 directly. As illustrated in FIG. 16, the fixing device 20X further includes the fixing belt 21, the low-friction sheet 23, the nip formation member 26, the pressing roller 31, and a holding member 51. The nip formation member 26 includes the rubber pad 40 and the sheet holder 41.

The fixing belt 21 includes a conductive layer serving as an inner layer. When magnetic lines of force generated by the induction heater 50 penetrate the conductive layer of the fixing belt 21, an eddy current generates in the conductive layer of the fixing belt 21 to form a magnetic field that prevents change of an alternating magnetic field generated by the magnetic lines of force. When the eddy current flows through the conductive layer of the fixing belt 21, Joule heat proportional to resistance of the conductive layer of the fixing belt 21 generates and heats the fixing belt 21.

The holding member 51 is provided inside the loop formed by the fixing belt 21, and supports or holds the rubber pad 40 and the sheet holder 41 which sandwich and hold the low-friction sheet 23.

In the fixing devices 20, 20W, and 20X according to the above-described exemplary embodiments, the pressing roller 31 is used as a pressing member. Alternatively, a pressing belt or a pressing pad may be used as a pressing member to provide effects equivalent to the effects provided by the pressing roller 31.

Further, the fixing belt 21, which may have a multi-layer structure, is used as a fixing member. Alternatively, an endless fixing film including polyimide resin, polyamide resin, fluorocarbon resin, or thin metal plate may be used as a fixing member to provide effects equivalent to the effects provided by the fixing belt 21.

The following describes the effects provided by the fixing devices 20, 20W, and 20X according to the above-described exemplary embodiments.

The fixing device (e.g., the fixing device 20, 20W, or 20X) includes a flexible endless fixing member (e.g., the fixing belt 21), and a nip formation member (e.g., the nip formation member 26, 26S, 26T, 26U, or 26V) pressed against a pressing member (e.g., the pressing roller 31) via the fixing member to form a nip (e.g., the fixing nip N) between the fixing member and the pressing member through which a recording medium bearing a toner image passes. The fixing member and the pressing member rotate and convey the recording medium bearing the toner image through the nip. The nip formation member includes a plurality of sandwiching members, that is, a first sandwiching member (e.g., the rubber pad 40, 42, 42U, or 45) and a second sandwiching member (e.g., the sheet holder 41, 41S, or 43, or the outer sheet holder 47), which fixedly sandwich a low-friction sheet (e.g., the low-friction sheet 23) facing the nip.

With this configuration, the plurality of sandwiching members sandwiches and holds the low-friction sheet. Accordingly, the plurality of sandwiching members and the low-friction sheet are integrated into a unit as the nip formation member. Consequently, the nip formation member is assembled and installed into the fixing device easily at reduced manufacturing costs.

The first sandwiching member and the second sandwiching member are substantially planar or plate-shaped, and include one of rubber, resin, and metal.

The first sandwiching member engages the second sandwiching member with the low-friction sheet interposed therebetween.

With this configuration, the plurality of sandwiching members sandwiching the low-friction sheet is assembled into the nip formation member without using a fastener such as a screw. Consequently, the nip formation member is assembled and installed into the fixing device more easily at reduced manufacturing costs.

The low-friction sheet is a porous sheet including polytetrafluoroethylene. The first sandwiching member is provided closer to the nip than the second sandwiching member, and includes one of fluorocarbon resin and silicon rubber.

With this configuration, the fixing member slides over the low-friction sheet smoothly, and pressure applied by the pressing member to the nip formation member at the nip is leveled.

The first sandwiching member comprises a rubber pad and the second sandwiching member comprises a metal sheet holder. The rubber pad engages the metal sheet holder via the low-friction sheet sandwiched between the rubber pad and the metal sheet holder.

With this configuration, the rubber pad and the metal sheet holder are engaged with each other in a state in which the rubber pad and the metal sheet holder sandwich the low-friction sheet. Accordingly, the rubber pad and the metal sheet holder hold the low-friction sheet precisely without using a fastener such as a screw.

The low-friction sheet is replaceable.

With this configuration, only the low-friction sheet is replaced with new one, suppressing maintenance costs.

A holding member (e.g., the holding member 22 or 51) is provided inside a loop formed by the fixing member to contact the fixing member to maintain a predetermined shape of the fixing member.

With this configuration, the holding member maintains the endless belt shape of the fixing member.

The holding member holds the nip formation member at a predetermined position. The holding member includes a concave portion (e.g., the concave portion 22*a*) facing the nip and holding the nip formation member.

With this configuration, the holding member holds the nip formation member precisely.

A heater (e.g., the halogen heater 25 or the induction heater 50) heats the fixing member via the holding member heated by the heater, or heats the fixing member directly. The holding member includes a metal pipe.

With this configuration, the holding member that maintains the endless belt shape of the fixing member also heats the fixing member.

An image forming apparatus (e.g., the image forming apparatus 1) includes an image forming device (4Y, 4M, 4C, or 4K) that forms a toner image on a recording medium, and the fixing device that fixes the toner image on the recording medium.

With this configuration, the image forming apparatus installed with the fixing device is manufactured at reduced costs, and forms a high-quality image with stable fixing processing.

The present invention has been described above with reference to specific exemplary embodiments. Note that the present invention is not limited to the details of the embodiments described above, but various modifications and enhancements are possible without departing from the spirit and scope of the invention. It is therefore to be understood that the present invention may be practiced otherwise than as specifically described herein. For example, elements and/or features of different illustrative exemplary embodiments may be combined with each other and/or substituted for each other within the scope of the present invention.

What is claimed is:

1. A fixing device for fixing a toner image on a recording medium, comprising:

a flexible endless fixing member to rotate in a predetermined direction of rotation, formed into a loop;

a nip formation member provided inside the loop formed by the fixing member;

a pressing member pressed against the nip formation member via the fixing member to form a nip between the fixing member and the pressing member through which the recording medium bearing the toner image passes;

the fixing member and the pressing member rotating and conveying the recording medium bearing the toner image through the nip; and a low-friction sheet covering the nip formation member, the low-friction sheet over which the fixing member slides;

the nip formation member comprising:

a first sandwiching member covered by the low-friction sheet; and a second sandwiching member to sandwich the low-friction sheet together with the first sandwiching member.

2. The fixing device according to claim 1, wherein the first sandwiching member and the second sandwiching member are substantially planar, and include one of rubber, resin, and metal.

3. The fixing device according to claim 1, wherein the first sandwiching member engages the second sandwiching member with the low-friction sheet interposed therebetween.

4. The fixing device according to claim 1, wherein the low-friction sheet is a porous sheet including polytetrafluoroethylene, and wherein the first sandwiching member is provided closer to the nip than the second sandwiching member, and includes one of fluorocarbon resin and silicon rubber.

5. The fixing device according to claim 1, wherein the first sandwiching member comprises a rubber pad and the second sandwiching member comprises a metal sheet holder, and wherein the rubber pad engages the metal sheet holder via the low-friction sheet sandwiched between the rubber pad and the metal sheet holder.

6. The fixing device according to claim 1, wherein the first sandwiching member comprises a concave portion facing the second sandwiching member, and wherein the concave portion of the first sandwiching member engages the second sandwiching member with the low-friction sheet interposed therebetween.

7. The fixing device according to claim 6, wherein the second sandwiching member comprises one of a convex portion and a rectangular portion facing the first sandwiching member, and wherein the one of the convex portion and the rectangular portion of the second sandwiching member engages the concave portion of the first sandwiching member with the low-friction sheet interposed therebetween.

8. The fixing device according to claim 1, wherein the second sandwiching member comprises a concave portion facing the first sandwiching member, and wherein the first sandwiching member engages the concave portion of the second sandwiching member with the low-friction sheet interposed therebetween.

9. The fixing device according to claim 8, wherein the first sandwiching member comprises one of a convex portion and a rectangular portion facing the second sandwiching member, and wherein the concave portion of the second sandwiching member engages the one of the convex portion and the rectangular portion of the first sandwiching member with the low-friction sheet interposed therebetween.

10. The fixing device according to claim 1, further comprising a third sandwiching member to sandwich the low-friction sheet together with the first sandwiching member and the second sandwiching member, the third sandwiching member comprising a slit extending in a longitudinal direction of the third sandwiching member, wherein the first sandwiching member comprises:

a protrusion engaging the slit of the third sandwiching member via the low-friction sheet; and hook portions provided on lateral edges of the first sandwiching member in a short direction of the first sandwiching member, respectively, to engage the second sandwiching member via the low-friction sheet.

11. The fixing device according to claim 1, wherein the low-friction sheet is detachably attached to the nip formation member for replacement.

12. The fixing device according to claim 1, further comprising a holding member provided inside the loop formed by the fixing member to contact the fixing member to maintain a predetermined shape of the fixing member.

13. The fixing device according to claim 12, wherein the holding member holds the nip formation member at a predetermined position.

14. The fixing device according to claim 13, wherein the holding member comprises a concave portion facing the nip and holding the nip formation member.

15. The fixing device according to claim 12, further comprising a heater provided inside the loop formed by the fixing member to heat the fixing member via the holding member heated by the heater.

16. The fixing device according to claim 12, further comprising a heater provided outside the loop formed by the fixing member to heat the fixing member directly.

17. The fixing device according to claim 12, further comprising a heater provided outside the loop formed by the fixing member to heat the fixing member via the holding member heated by the heater.

18. The fixing device according to claim 12, wherein the holding member comprises a metal pipe.

19. An image forming apparatus comprising:

an image forming device to form a toner image on a recording medium; and the fixing device according to claim 1.

* * * * *